US006988549B1

(12) United States Patent
Babcock

(10) Patent No.: US 6,988,549 B1
(45) Date of Patent: Jan. 24, 2006

(54) SAGD-PLUS

(76) Inventor: John A Babcock, 2120 Texas St. #2409, Houston, TX (US) 77003

( * ) Notice: Subject to any disclaimer, the term of this patent is extended or adjusted under 35 U.S.C. 154(b) by 79 days.

(21) Appl. No.: 10/714,102

(22) Filed: Nov. 14, 2003

(51) Int. Cl.
*E21B 43/24* (2006.01)

(52) U.S. Cl. ..... 166/267; 166/272.3

(58) Field of Classification Search ..... 166/265, 166/266, 267, 272.3, 303; 60/39.12, 39.182
See application file for complete search history.

(56) References Cited

U.S. PATENT DOCUMENTS

| | | | | |
|---|---|---|---|---|
| 4,007,786 | A | 2/1977 | Schlinger | |
| 4,344,485 | A | 8/1982 | Butler | |
| 4,398,603 | A * | 8/1983 | Rodwell | 166/267 |
| 4,694,907 | A | 9/1987 | Stahl | |
| 5,503,226 | A | 4/1996 | Wadleigh | |
| 5,626,193 | A | 5/1997 | Nzekwu | |
| 5,826,655 | A | 10/1998 | Snow | |
| 6,230,814 | B1 | 5/2001 | Nasr | |
| 6,240,718 | B1 | 6/2001 | Fetescu | |
| 6,257,334 | B1 | 7/2001 | Cyr | |
| 6,357,526 | B1 | 3/2002 | Abdel-Halim | |
| 6,536,523 | B1 | 3/2003 | Kresnyak | |
| 2002/0134083 | A1 * | 9/2002 | Staphanos et al. | 60/698 |
| 2003/0131582 | A1 * | 7/2003 | Anderson et al. | 60/39.55 |

* cited by examiner

*Primary Examiner*—William Neuder
(74) *Attorney, Agent, or Firm*—Conley Rose, P.C.

(57) ABSTRACT

A combination of SAGD with cogeneration technology for exploiting shallow heavy oil and bitumen reservoirs under primary, secondary and tertiary thermal recovery. Superheated steam is generated by the heat recovery from the exhaust of an above-ground hydrocarbon powered turbine driven electric generator cogeneration plant and is injected through well bores into the hydrocarbon bearing reservoir that is traversed by at least one horizontal producing well bore and one injection well bore to heat the reservoir formation and to induce gravity drainage of the hydrocarbons and allowing their recovery from the horizontal producing well bore. Electrical power that is generated is sold to the electric grid and can be used to offset the fuel costs for the above ground hydrocarbon turbine-driven elector generators.

11 Claims, 9 Drawing Sheets

SAGD-PLUS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

Field of Invention

This invention relates generally to thermally-enhanced primary, secondary and tertiary oil recovery methods by combining steam assisted gravity drainage (SAGD) technology with hydrocarbon fueled turbine driven electrical cogeneration exhaust heat that is exchanged with feed water to supply the superheated steam to heat shallow hydrocarbon reservoir formations.

BACKGROUND OF THE INVENTION

Hydrocarbon recovery can be enhanced in certain heavy oil and bitumen reservoirs by drilling closely spaced vertical production and steam injection well bores into the hydrocarbon reservoir formations and injecting steam. Under this conventional thermal secondary recovery technique, the steam can cause the heavy hydrocarbons to become mobile due to the reduction of its in-situ viscosity.

Several improvements have been made to enhance recovery of heavy oils and bitumens beyond conventional thermal techniques. One such technique is U.S. Pat. No. 4,344,485 issues Aug. 17, 1982 to Butler teaches a Steam Assisted Gravity Drainage (SAGD) method where pairs of horizontal wells, one vertically above the other are connected by a vertical fracture. A steam chamber rises above the upper well and oil warmed by conduction drains along the outside wall of the chamber to the lower production well.

The benefits of SAGD over conventional secondary thermal recovery techniques include higher oil productivity relative to the number of wells employed, higher ultimate recovery of oil in place and lower steam oil ratios.

There are problems associated with typical SAGD projects more particularly:

The economics of thermally enhanced hydrocarbon recovery projects is significantly impacted by the costs associated with generating steam. The hydrocarbon fuel to fire these boilers is usually the single most significant operating cost in a thermally enhanced recovery project and SAGD project are typically shut-in when the cost of fuel and other operating costs exceed the project's revenue; and SAGD does not typically employ the use of super saturated steam because of the high cost of producing this steam with conventional hydrocarbon fired tube boilers. This results in using 70–80% quality steam that is less efficient in transferring heat to the heavy oil reservoir; and The produced water associated with the hydrocarbon production from these operations is typically disposed of in commercially operated disposal wells for a fee.

U.S. Pat. No. 4,007,786 issued Feb. 15, 1977 to Schlinger, attempted to address the steam generation costs associated with conventional secondary recovery thermal projects through the use of a gas turbine and electrical generator to generate steam and to produce raw fuel by partial oxidation of the produced hydrocarbons. However, this process has several shortcomings including:

It did not address the application to SAGD technology; and

It did not address a process for primary and tertiary thermal recovery projects for heavy oil and bitumen reservoirs; and It did not address the operation of the gas turbine generator in simple or combined cycle; and It did not address the use of superheated steam and a heat recovery and steam-generating unit (HRSG) that is employed in generating superheated steam through cogeneration.

Other inventions have been created to overcome some of these operating issues. U.S. Pat. No. 4,694,907 utilizes cogeneration and electrical down hole steam generators to attempt thermally enhanced oil recovery in deep well reservoirs. This process is focused at overcoming heat losses associated with thermal recovery operations in deep reservoirs. This process has several shortcomings:

The combination of cogeneration and down hole heaters is very expensive and its application is for deep reservoirs; and The process does not address the use with SAGD technology.

The object of my invention is to link two distinct concepts an electrical/steam cogeneration station to generate superheated steam with SAGD and to take advantage of the economic benefits that accrue through the use of combining these technologies for primary secondary and tertiary thermal recovery in shallow heavy oil reservoirs.

SUMMARY OF THE INVENTION

The object of this invention, therefore, is to provide a combination of an electrical/steam cogeneration station and steam assisted gravity drainage, in which super heated steam is generated at low cost from the exhaust heat from a gas fired turbine by heat exchange with feed water which is continuously delivered to the hydrocarbon reservoir formation via one or more horizontal or vertical injection well bores in order to induce SAGD in primary, secondary and tertiary thermal recovery projects.

The maximum practical pressure that steam can be raised to for thermal recovery operations is 2000 psig. This limits the applicability of this process to shallow reservoirs (less than 4000 feet vertical depth) with bottom hole reservoir pressures of less than 2000 psig due to the low hydrostatic head of the superheated steam.

It is therefore a primary aspect of one embodiment of this invention to provide an economically valuable method to recover viscous hydrocarbons from shallow hydrocarbon reservoirs using pairs of horizontal well bores or a combination of vertical and horizontal well bores and stimulating gravity drainage by the injection of superheated steam into the hydrocarbon reservoir formation by heat exchange of feed water with the exhaust gas from a gas fired turbine cogeneration facility.

It is another aspect of embodiment of the invention to provide an economically valuable method to reduce the high operating costs associated with the generation of high quality superheated steam by selling the electricity that is created by the cogeneration unit running in either simple or combined cycle into an electrical grid.

It is another aspect of an embodiment of this invention to provide an economically valuable method to recover and recycle produced reservoir formation water to supplement the feed water for the heat recovery steam-generating unit (HRSG) to generate superheated steam.

BRIEF DESCRIPTION OF THE DRAWINGS

A more complete appreciation of the invention and many attendant advantages thereof will be readily obtained as the same becomes better understood by reference to the following detailed description, when considered in connection with the accompanying drawings, wherein.

DESCRIPTION OF THE PREFERRED EMBODIMENTS

The thermally enhanced oil recovery system in accordance with the present invention provides a method for exploiting shallow hydrocarbon reservoir formations under primary, secondary and tertiary recovery by utilizing horizontal producing and either horizontal or vertical injection wells and surface cogeneration facility to provide the superheated high quality steam required to mobilize the in-situ hydrocarbons under gravity drainage.

Figure 1:
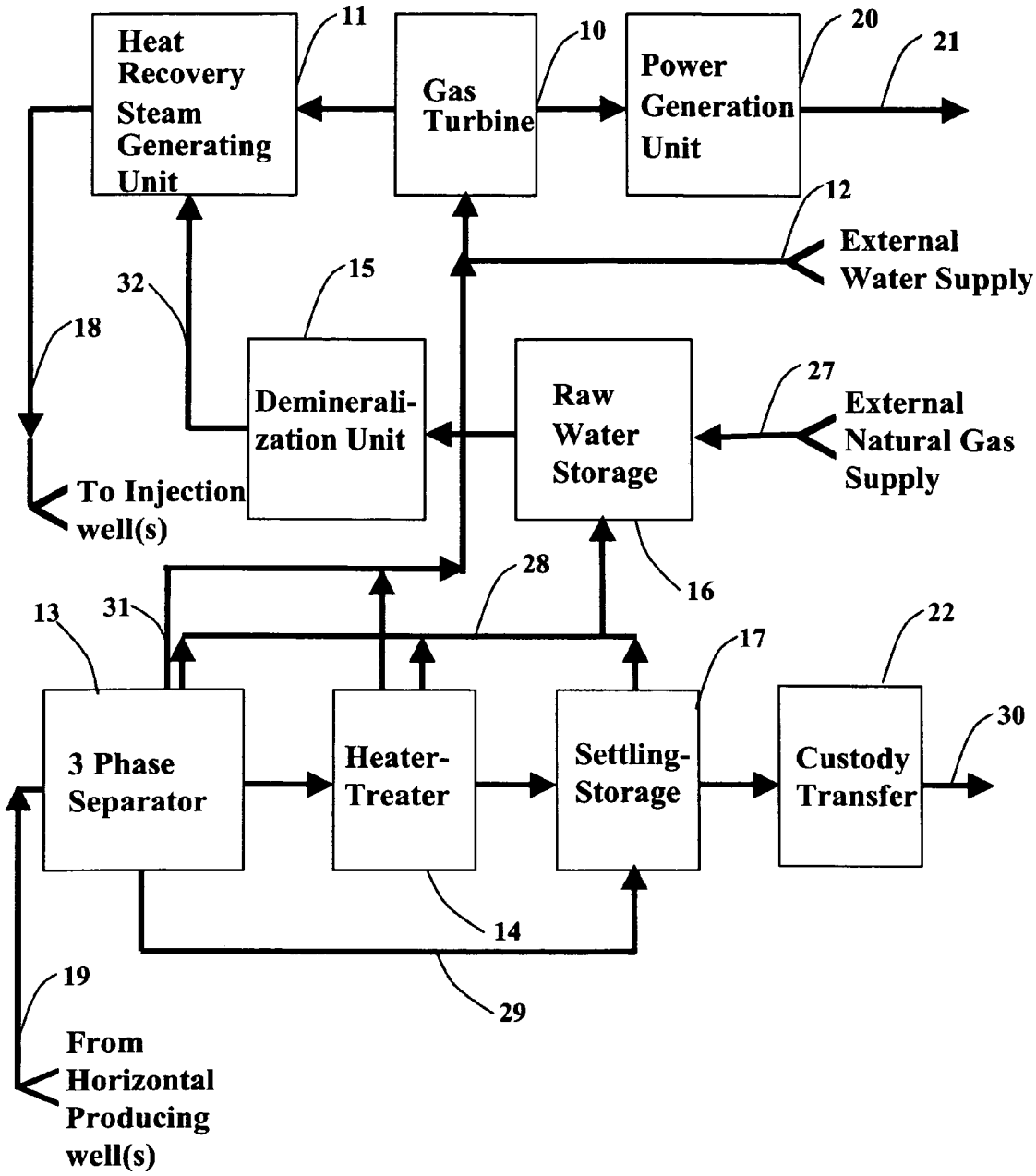
FIG. 1 shows a plan section of the surface process flow assembly operating in simple-cycle with steam injection.

FIG. 1 shows a plan schematic of the surface equipment for the invention running in simple-cycle. The above ground cogeneration consists of the gas turbine 10, the power generation unit 20 and the heat recovery steam generating (HRSG) unit 11. The gas fueled turbine 10 supplies exhaust heat to the HRSG unit 11. The gas turbine unit 10 is fueled by an external natural gas supply 12 and by the associated reservoir formation hydrocarbon gas that has been delivered to the surface to the production header 19 and recovered from the three-phase (liquid hydrocarbon, water and natural gas) separator 13 and the heater-treater unit. Said gas is delivered to the gas turbine 10 via the low pressure gas header line 31.

The demineralization unit 15 provides demineralized feed water to the heat recovery steam-generating unit 11 via water line 32. The heat recovery steam-generating unit 11 generates superheated high quality steam to the steam header 18 that is fed into each horizontal injection well(s).

Feed water is provided to the demineralization unit 15 from an external water well or other surface water source 27 that is stored in the raw water storage tank 16 and from the three-stage separator (oil, water and natural gas) 13 through water line header 28, the heater-treater unit 14 through water line header 28 and the settling and storage tank 17 through water line header 28.

The gas turbine unit 10 also provides high pressure/temperature gas that drives the electrical power generator 20 and generates electricity that is sold in the local power grid 21.

Liquid hydrocarbons that are separated in the 3-phase separator 13 are transferred to settling and storage tank 17 via line 29. The liquid hydrocarbon from settling and storage tank 17 is delivered to a custody transfer unit 22 and is sold to a local pipeline or refinery company via line 30.

Figure 2:
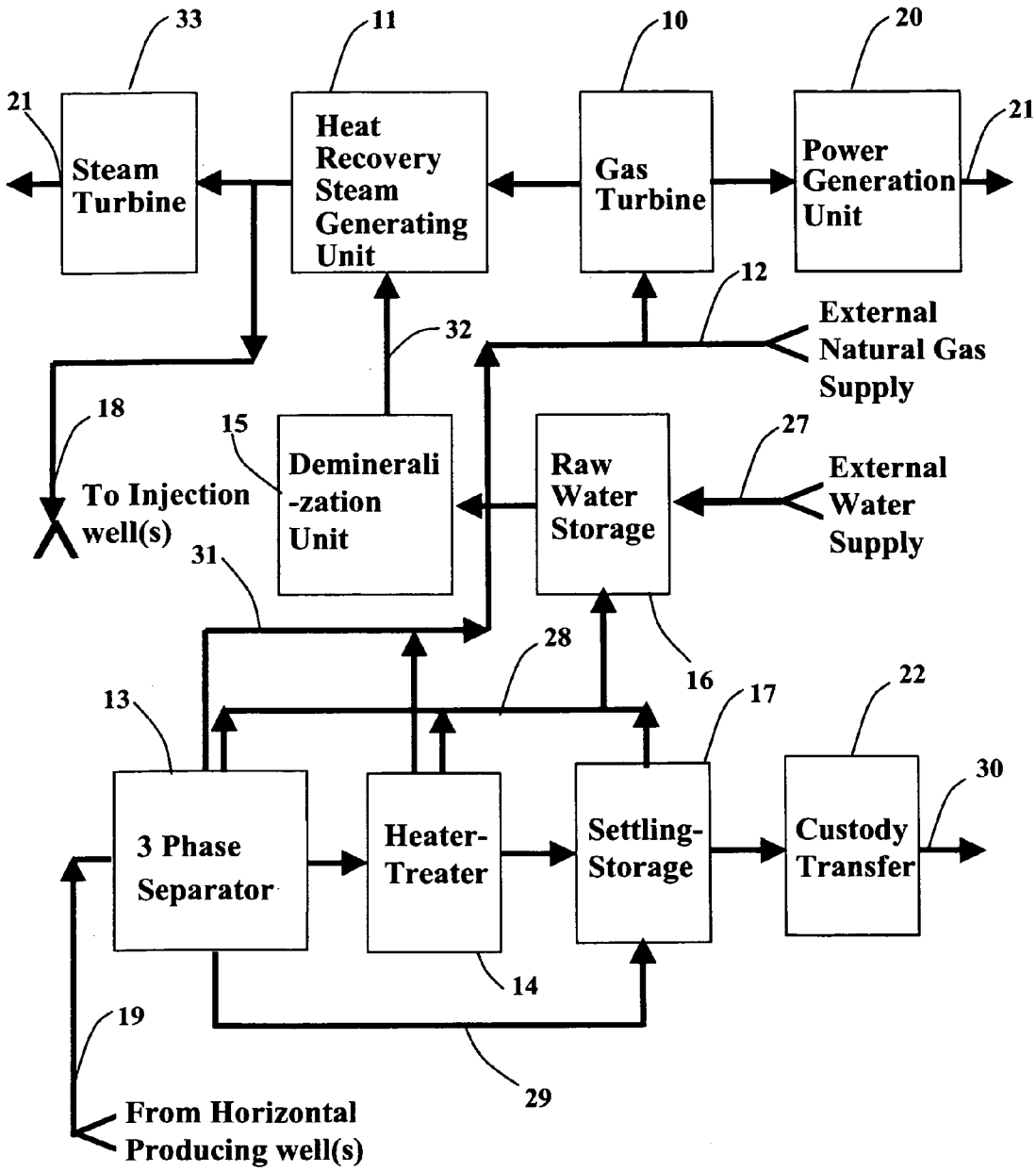
FIG. 2 shows a plan section of the surface process flow assembly operating in combined-cycle with steam injection.

FIG. 2 shows a plan schematic of the surface equipment for the invention running in combined-cycle. The above ground cogeneration consists of the gas turbine 10, the power generation unit 20, the heat recovery steam generating unit 11 and the steam turbine unit 33. The gas fueled turbine 10 supplies exhaust heat to the heat recovery steam generating unit 11. The gas turbine unit 10 is fueled by an external natural gas supply 12 and by the associated reservoir formation hydrocarbon gas that has been delivered to the surface to the production header 19 and recovered from the three-phase separator 13 and the heater-treater unit 14. Said gas is delivered to the gas turbine 10 via the low pressure gas header line 31.

The demineralization unit 15 provides demineralized feed water to the heat recovery steam-generating unit 11 via water line 32. The heat recovery steam-generating unit 11 generates superheated high quality steam a portion of which is delivered to the steam header 18 that is fed into each horizontal injection well(s) and another portion that is delivered to the steam turbine 33. The steam turbine generates electrical power that is sold in the local power grid 21.

Feed water is provided to the demineralization unit 15 from an external water well or other surface water source 27 that is stored in the raw water storage tank 16 and from the three-stage separator 13 through water line header 28, the heater-treater unit 14 through water line header 28 and the settling and storage tank 17 through water line header 28.

The gas turbine unit 10 also provides high pressure/temperature gas that drives the electrical power generator 20 and generates electricity that is sold in the local power grid 21.

Liquid hydrocarbons that are separated in the 3-phase separator 13 are transferred to settling and storage tank 17 via line 29. The liquid hydrocarbon from settling and storage tank 17 is delivered to a custody transfer unit 22 and is sold to a local pipeline or refinery company via line 30.

Figure 3:
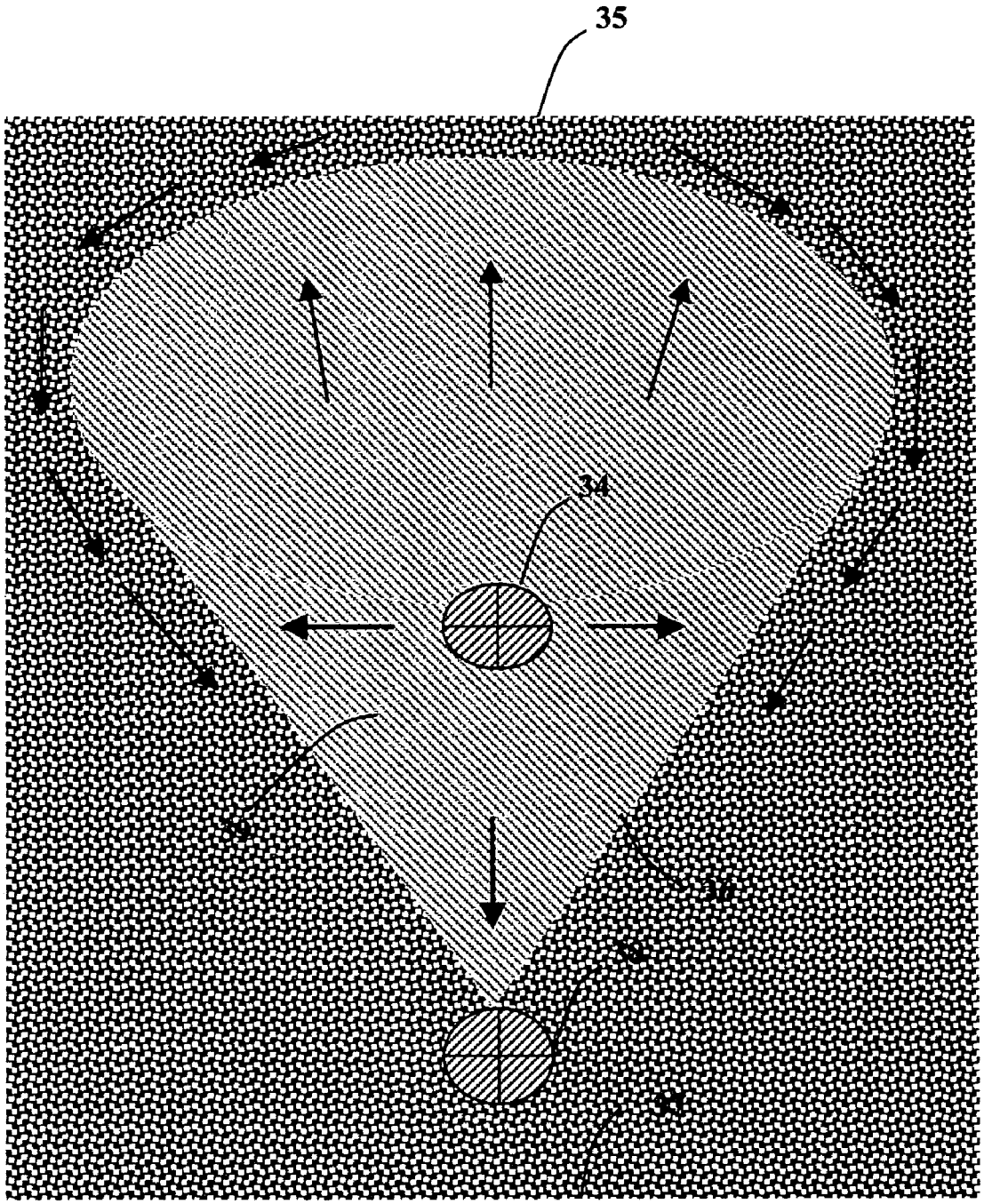
Fig. 3 Prior Art
FIG. 3 is a fanciful schematic of prior art that shows a vertical section (end view) of a steam chamber and the mobilization of hydrocarbons under gravity drainage with horizontal injection and production well bores.

FIG. 3 is a schematic of prior art that shows a vertical section (end view) through the hydrocarbon reservoir formation where horizontal injection and production well bores are used. Superheated high quality steam from the steam header 18 in FIG. 1 and FIG. 2 enters the horizontal injection well bore 34 at the surface and proceeds under pressure to the hydrocarbon reservoir where it then expands upward and outward to form a steam chamber 39. The ceiling of the hydrocarbon reservoir 35 acts as a partial flow boundary to heat flow. The expanding steam chamber 39 mobilizes adjacent hydrocarbons at the ceiling of the reservoir formation 35 and causes the hydrocarbons and steam to condense along the steam chamber wall 36. Gravity drainage causes the condensed mixture of hydrocarbons and water to flow downward to the base of the reservoir formation 37 where it is recovered in the horizontal producing well bore 38 that is located near the base of the heavy oil or bitumen reservoir 37.

The hydrocarbons and associated formation water are produced back to the surface through horizontal producing well bore 38 under artificial lift or natural flow to the surface production header 19 in FIG. 1 and FIG. 2.

The vertical thickness of the hydrocarbon reservoir formation from the base 37 to the top 35 must be at least 30 feet in order to initiate gravity drainage.

Figure 4:
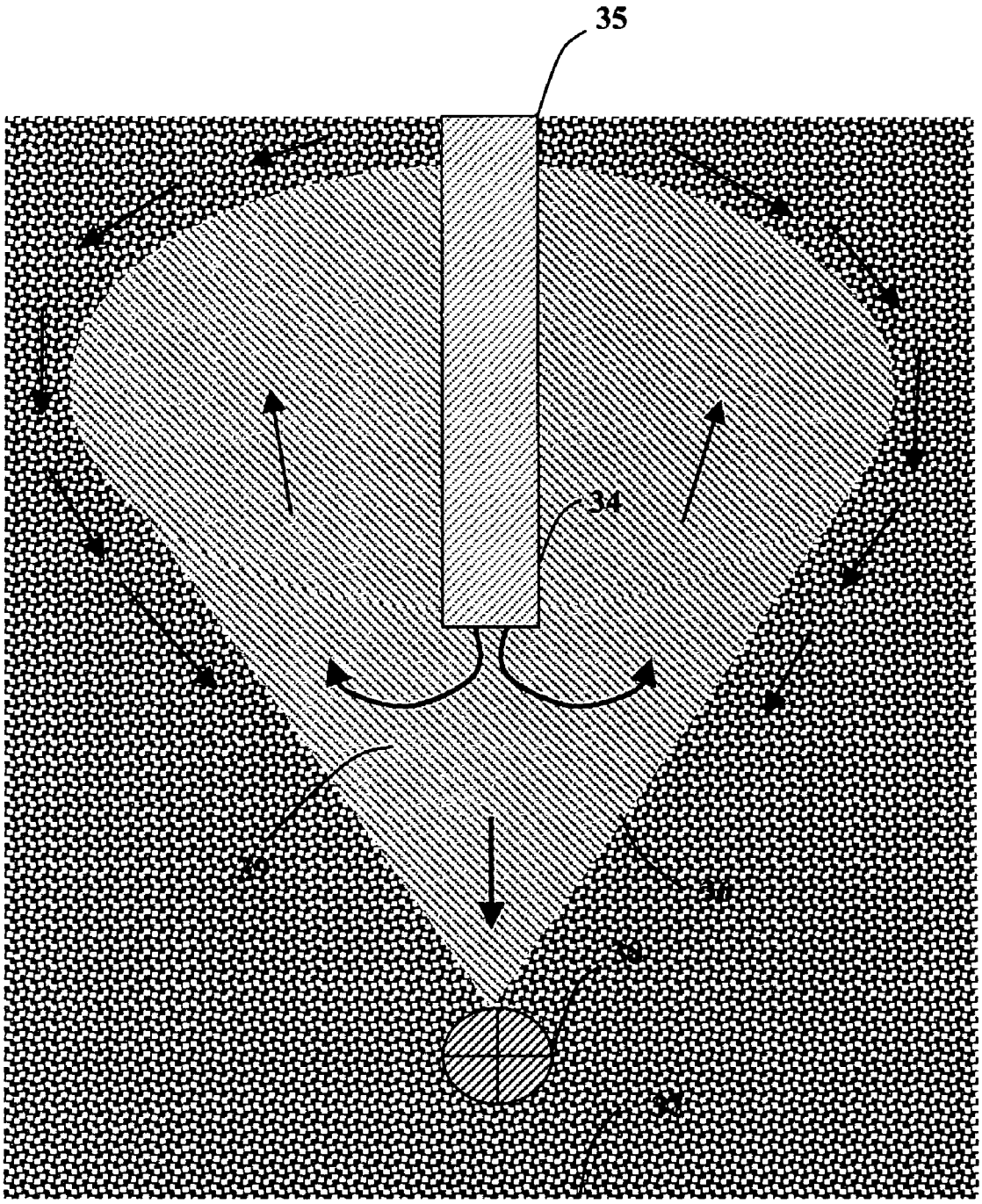
Fig. 4 Prior Art
FIG. 4 is a fanciful schematic of prior art that shows a vertical section (end view) of a steam chamber and the mobilization of hydrocarbons under gravity drainage with vertical injection and a horizontal production well bores.

FIG. 4 is a schematic of prior art that shows a vertical section (end view) through the hydrocarbon reservoir formation using a vertical injection well bore. Superheated high quality steam from the steam header 18 in FIG. 1 and FIG. 2 exits the vertical injector well bore 34 and rises vertically in the hydrocarbon reservoir formation to form a steam chamber 39. The vertical injector well bore 34 is located above the horizontal producing well bore 38 to minimize the possibility of accidentally coning steam downward. Accidental steam breakthrough into the horizontal producing well bore 38 will reduce the hydrocarbon recovery from the formation reservoir and will lead to the increase of thermal recovery operating costs.

Hydrocarbons and steam are condensed along the steam chamber walls 36 and flow downward due to the effect of gravity drainage until they are recovered by the horizontal producing well bore 38. The horizontal producing well bore is located as close the base of the hydrocarbon reservoir formation 37 as is practical in order to maximize the recovery of hydrocarbons.

Figure 5:
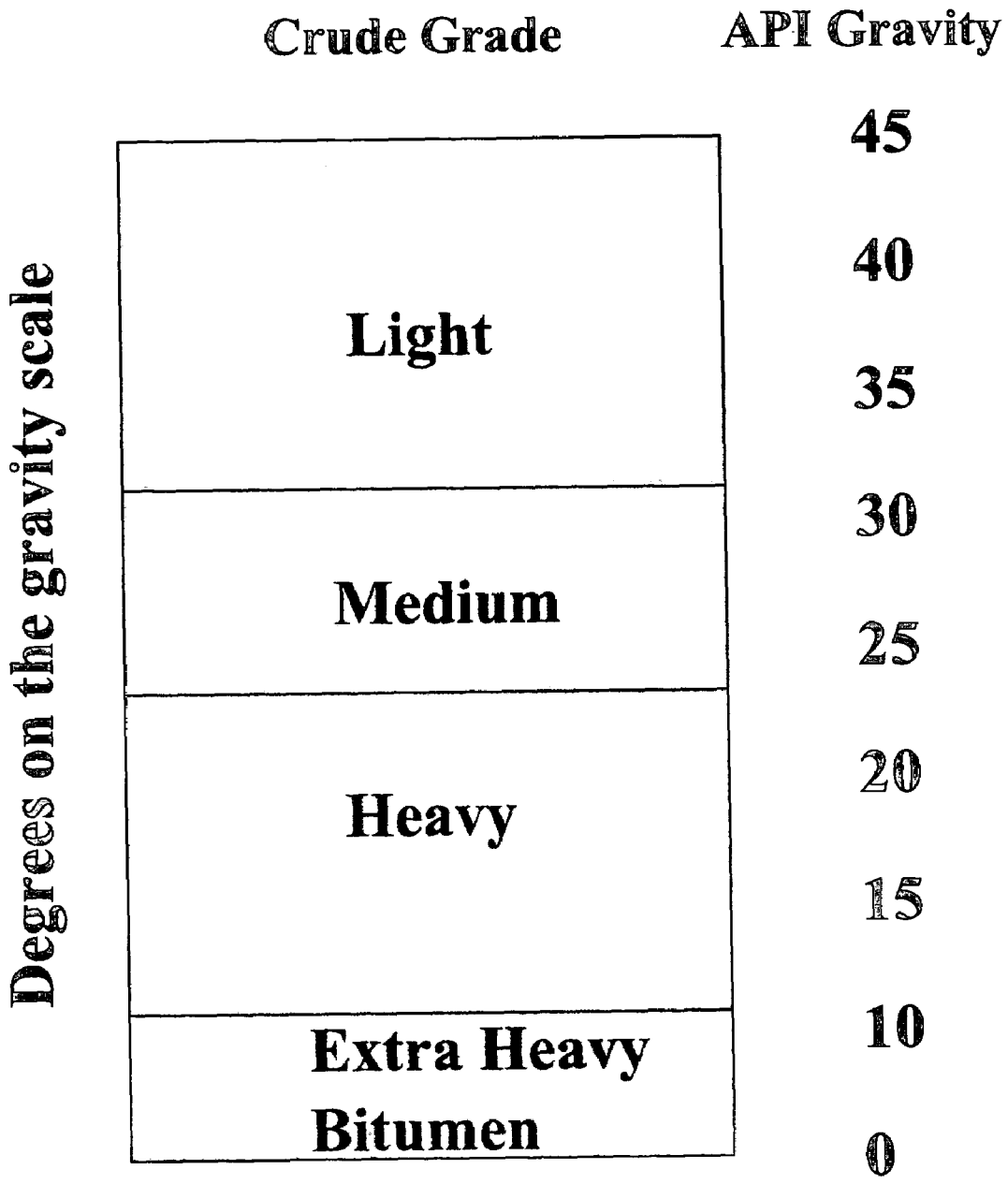
FIG. 5 is a fanciful schematic that shows the American Petroleum Institute gravity of commonly referred to grades of crude oil.

FIG. 5 is a schematic that shows the grading of typical crude oils in accordance with the American Petroleum Institutes (API) gravity calculation. The process's described in FIGS. 1 and 2 pertain to heavy crude oils with API gravities ranging from between 10 to 22 degrees.

Figure 6:
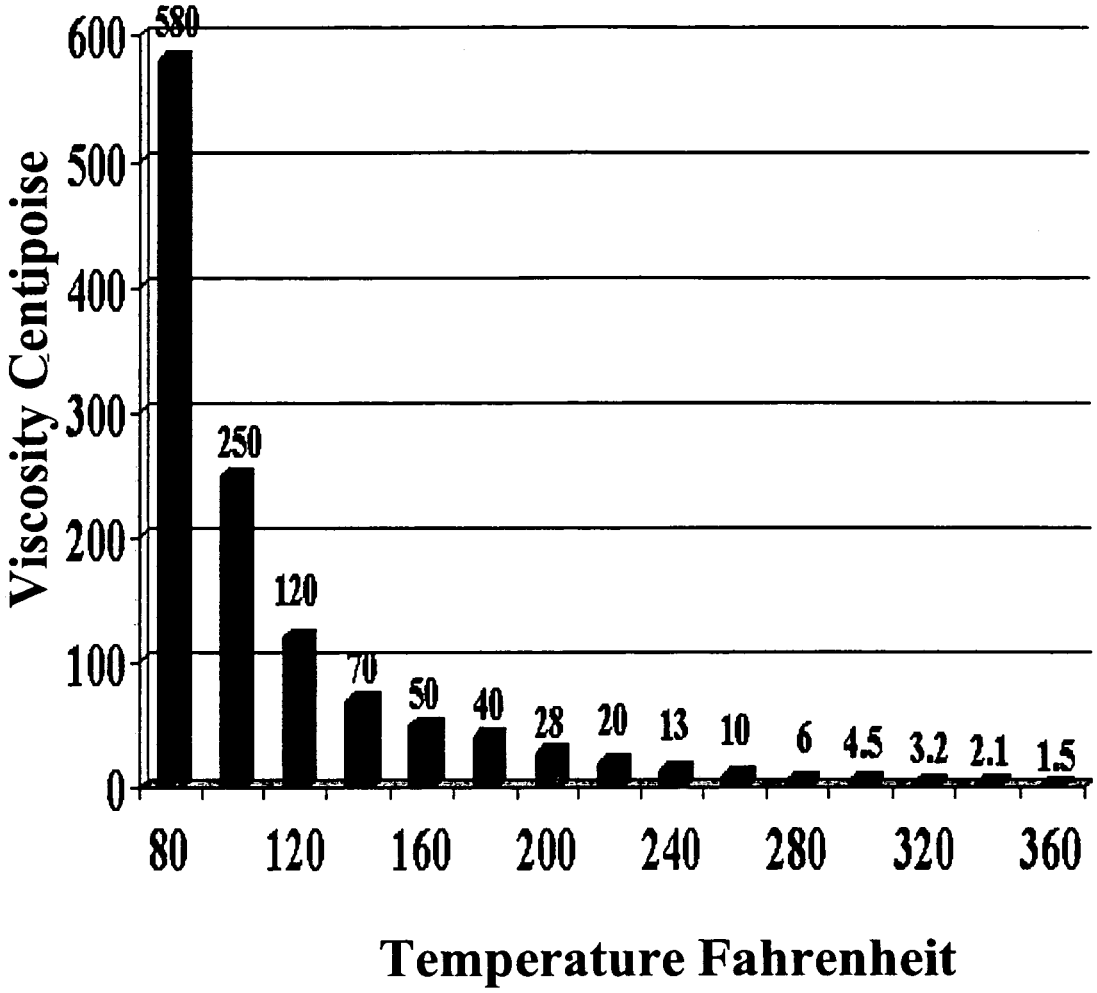
Fig. 6 Prior Art
FIG. 6 is a graph schematic of prior art that show the relationship between viscosity and temperature for a typical heavy oil crude.

FIG. 6 is a graph of prior art that shows the relationship between viscosity and temperature that was developed by Chew & Connally for a typical heavy crude with an 18-degree API gravity. The process's described in FIG. 1 and FIG. 2 apply to heavy crude oils with in-situ viscosities that can be reduced to less than 150 centipoise under steam assisted gravity drainage. In most cases it is uneconomic to attempt thermal recovery if the in-situ hydrocarbon viscosity cannot be reduced below 150 centipoise.

Figure 7:
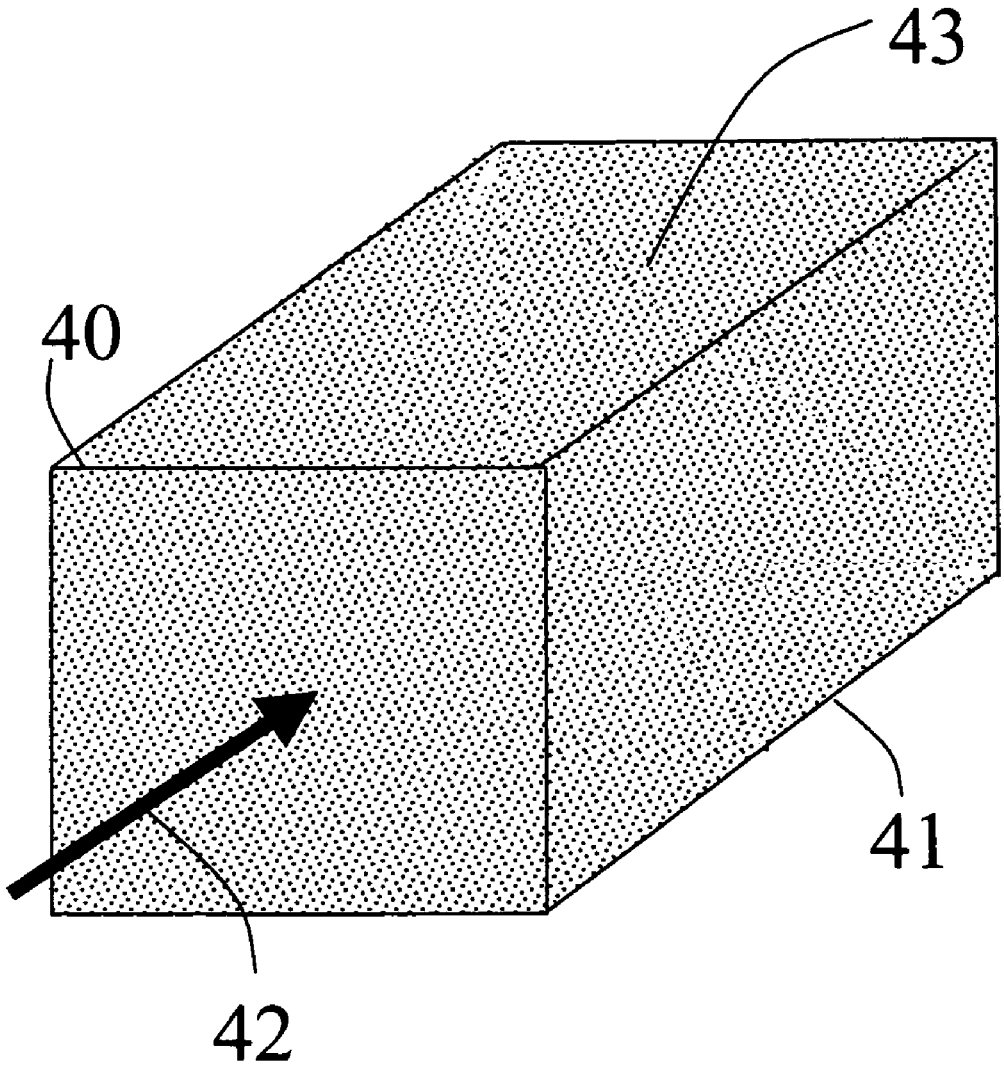
Fig. 7 Prior Art
FIG. 7 is a fanciful schematic of prior art that shows the derivation of permeability of a hydrocarbon-bearing reservoir.

FIG. 7 is a fanciful schematic of prior art that describes horizontal permeability. Permeability is defined as the resultant of the flow rate 42 multiplied by the viscosity of the wetting fluid in the porous media 43 and the length 41 that are divided by the cross sectional area to the flow 40 multiplied by the pressure drop over the length 41. This is mathematically represented by Darcy's Law as $k=Q\mu L/A\Delta P$ Where:

k=permeability measured in millidarcies

A=cross sectional area available for flow

L=length available for flow $\mu$=viscosity of the wetting fluid

Q=flow rate $\Delta P$=pressure drop across length L

The process's described in FIGS. 1 and 2 pertains to heavy crude oil reservoirs with permeability's greater than 200 millidarcies.

Figure 8:
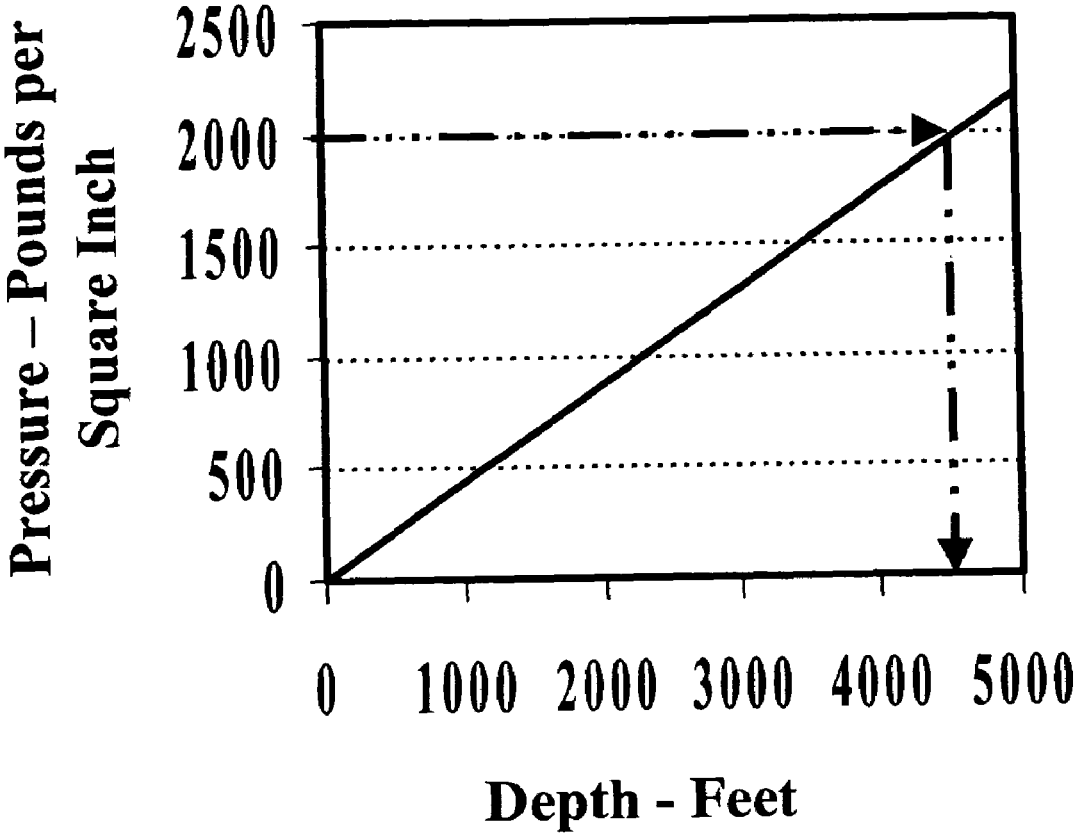
FIG. 8 is a graph that shows the relationship of pressure versus depth for a normally pressured reservoir.

FIG. 8 is a graph that shows the relationship between pressure and depth for a normally pressured heavy oil reservoir. A normally pressured reservoir is assumed to be the equivalent of a head of saltwater with a gradient of 0.433 pounds per square in per vertical foot of depth. The process's described in FIG. 1 and FIG. 2 pertains to heavy crude oil reservoirs with bottom hole reservoir pressures that are less than 2000 pounds per square inch at a depth shallower than 4600 feet.

Figure 9:
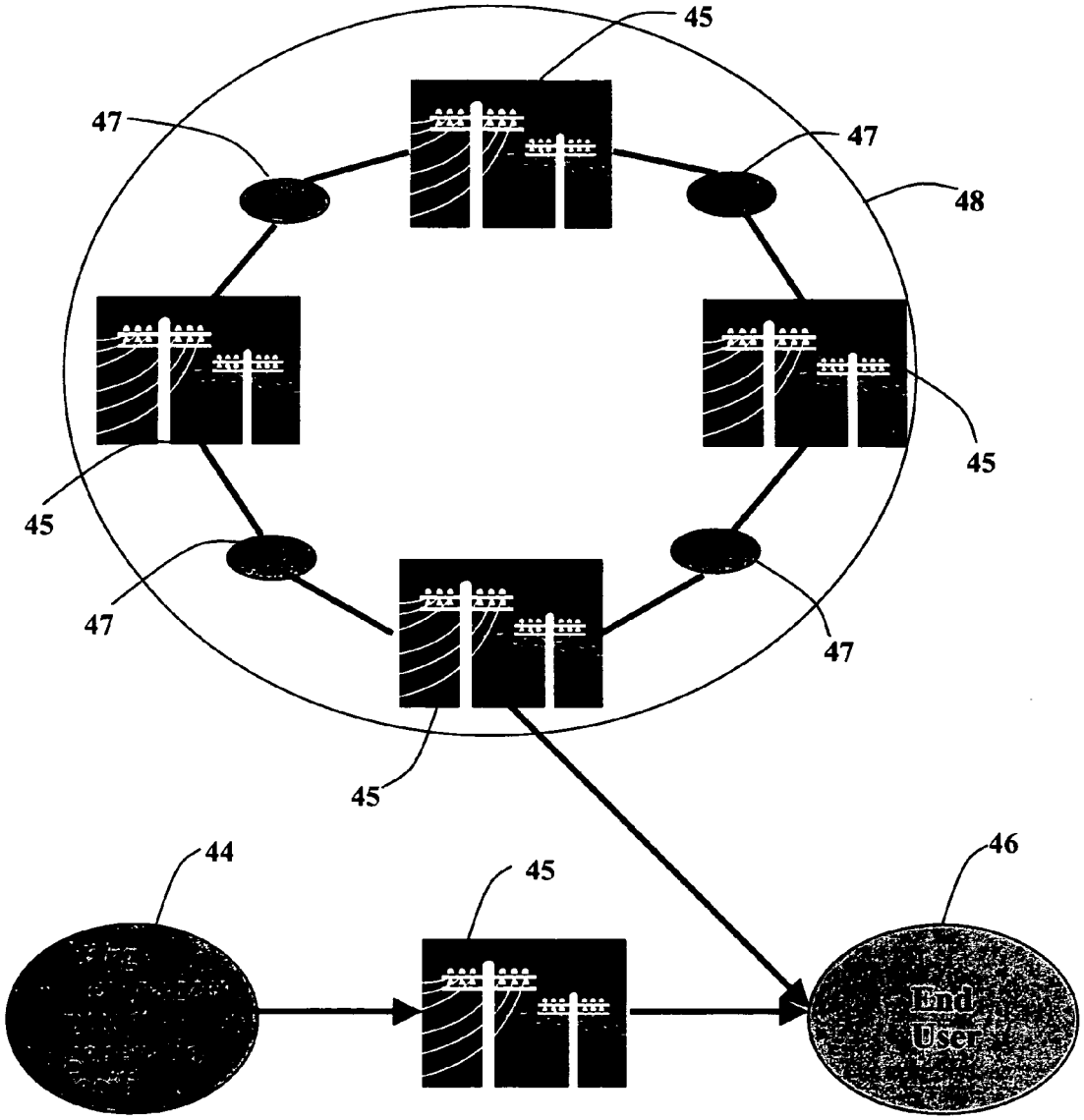
FIG. 9 is a fanciful schematic that shows the difference between a centralized and distributed power system.

FIG. 9 is a fanciful schematic that shows the difference between a centralized power system and a distributed power system. In the drawing, the large centralized power facility 44 generates power that is transmitted through the power grid 45 to the end user 46. In a distributed power system 48, power is generated by small power plants 47 located remotely to each other with their power being transmitted through the grid 45 to the end user 46. The advantages of distributed power over centralized power generation include power grid stabilization and less vulnerability to catastrophic power line failure and loss of service to the end user 46. The process's described in FIG. 1 and FIG. 2 will utilize cogeneration facilities configured in a distributed power system.

The following example demonstrates the practice and utility of the present invention but is not to be construed as limiting the scope thereof:

EXAMPLE

A hydrocarbon reservoir is being considered for development under two scenarios; first, a conventional thermal recovery process using conventional boilers to generate steam and secondly by a SAGD process using hydrocarbon fired turbine-driven electrical generators and heat recovery steam generating units to produce superheated steam. In this example it is assumed that the reservoir requires 220,000 pounds of steam at 600 pounds per square inch (psi) and 400 degrees Fahrenheit (F); both the boilers and the turbine generators are fueled with natural gas that costs $4.65 per thousand standard cubic. A comparison of these two scenarios and the economic payout for the SAGD and cogeneration scenario are presented in Table I.

TABLE I

| Conventional Boiler Economics | Cogeneration Economics |
|---|---|
| Five-natural gas-fired tube boilers each rated at 40,000 pounds per hour (totaling 200,000 pounds of superheated steam per hour) and costing $400,000 | Two-27 megawatt natural gas fired turbine-driven electrical generators operated in simple cycle each equipped with a heat recovery steam generating unit rated at 110,000 pounds of steam per hour costing $13.5 million each |
| Assumed operating and maintenance costs are $36,000/month | Assumed operating and maintenance costs are $86,000/month |
| Assumed no Megawatts-hours of power generated | Assumed 48 net megawatt-hours generated |
| Assumed no value for electricity sold to the local grid | Assumed net operating income after operating, maintenance and fuel costs is $10,800/day |
| | Calculated payout for cogeneration is 6.8 years |

I claim:

1. A method for recovering hydrocarbons from a subsurface reservoir, the method comprising:

operating an above-ground, hydrocarbon-powered, turbine-driven, electric generator in simple cycle to produce electrical power and a heated exhaust;

generating a superheated high quality steam by passing water in a heat exchange relation with only the heated exhaust;

injecting the superheated steam through an injection well bore into the reservoir so as to heat the reservoir and induce steam assisted gravity drainage of the hydrocarbons; and extracting the hydrocarbons from the reservoir through a horizontal well bore located below the injection well bore.

2. A method according to claim 1, further comprising:

supplying a portion of the superheated steam to an electrical steam-driven generator so as to produce electrical power; and selling the electrical power from the above-ground, hydrocarbon-powered, turbine-driven, electric generator and the electrical steam-driven generator into an electric grid.

3. The method of claim 1, wherein the hydrocarbons have an API gravity of at least 10° but not greater than 22°.

4. The method of claim 1, wherein the reservoir has a vertical thickness greater than 30 feet.

5. The method of claim 1, wherein the viscosity of the hydrocarbons can be reduced to less than 150 centipoise at reservoir conditions.

6. The method of claim 1, wherein the reservoir has an average permeability greater than 200 millidarcies.

7. The method of claim 1, wherein the reservoir has a pressure that is less than 2000 pound per square inch.

8. The method of claim 1, wherein the horizontal well bore is located at a base of the reservoir.

9. The method of claim 1, further comprising supplying a portion of the hydrocarbons extracted from the formation to the above-ground, hydrocarbon-powered, turbine-driven, electric generator.

10. The method of claim 1, further wherein a portion of the water supplied in heat exchange relation with the exhaust is water that is simultaneously produced with the hydrocarbons from the formation.

11. The method of claim 1 wherein the electric generator is a component in a distributed power system.

* * * * *